US008604325B2

(12) United States Patent
Sato

(10) Patent No.: US 8,604,325 B2
(45) Date of Patent: Dec. 10, 2013

(54) MOUNTING STRUCTURE FOR CYMBALS, HI-HAT STAND, AND CLOSED HI-HAT ATTACHMENT

(75) Inventor: Naoki Sato, Nagoya (JP)

(73) Assignee: Hosino Gakki Co., Ltd, Aichi (JP)

( * ) Notice: Subject to any disclaimer, the term of this patent is extended or adjusted under 35 U.S.C. 154(b) by 74 days.

(21) Appl. No.: 13/104,987

(22) Filed: May 11, 2011

(65) Prior Publication Data

US 2012/0210843 A1 Aug. 23, 2012

(30) Foreign Application Priority Data

Feb. 23, 2011 (JP) ..... 2011-037104

(51) Int. Cl.
*G10D 13/02* (2006.01)

(52) U.S. Cl.
USPC ..... 84/422.3

(58) Field of Classification Search
USPC ..... 84/422.3
See application file for complete search history.

(56) References Cited

U.S. PATENT DOCUMENTS

| | | | | |
|---|---|---|---|---|
| 3,141,370 | A * | 7/1964 | Ross | 84/402 |
| 4,319,514 | A * | 3/1982 | Donohoe | 84/421 |
| 5,052,262 | A | 10/1991 | Havens | |
| 5,063,819 | A * | 11/1991 | Hoshino | 84/422.3 |
| 5,918,300 | A | 6/1999 | Hsieh | |
| 6,057,500 | A | 5/2000 | Liao | |
| 6,177,621 | B1 | 1/2001 | Hoshino | |
| 6,417,434 | B1 * | 7/2002 | Lao | 84/422.3 |
| 7,078,606 | B2 * | 7/2006 | Tanaka | 84/422.1 |
| 7,094,959 | B2 * | 8/2006 | Marnell | 84/422.3 |
| 7,820,899 | B2 * | 10/2010 | Liao | 84/422.3 |
| 2005/0150357 | A1 | 7/2005 | Tanaka | |
| 2005/0211063 | A1 | 9/2005 | Chang | |
| 2006/0272477 | A1 | 12/2006 | Liao | |
| 2010/0147136 | A1 | 6/2010 | Shigenaga | |
| 2010/0175536 | A1 | 7/2010 | Liao | |

FOREIGN PATENT DOCUMENTS

| | | | |
|---|---|---|---|
| JP | 53-024621 | U | 3/1978 |
| JP | 54-032114 | U | 3/1979 |
| JP | 55-016555 | U | 2/1980 |
| JP | 2010-145572 | A | 7/2010 |

OTHER PUBLICATIONS

Japanese Office Action dated Mar. 12, 2013 issued in Japanese Patent Application No. 2011-037104.

* cited by examiner

*Primary Examiner* — Christopher Uhlir

(57) ABSTRACT

A hi-hat bottom supports a bottom cymbal, through which a rod is passed, from below in a state fixed to the upper end of an upper pipe via a retainer. The hi-hat bottom has the retainer, a receiving plate, a compression coil spring, and a lock nut. When a foot plate is depressed, the compression coil spring urges a top cymbal and a bottom cymbal in such a direction that the cymbals contact each other. When the foot plate is not depressed, the bottom cymbal is inclined, together with the receiving plate, at a predetermined inclination angle with respect to a horizontal plane by the urging force of the compression coil spring.

10 Claims, 8 Drawing Sheets

MOUNTING STRUCTURE FOR CYMBALS, HI-HAT STAND, AND CLOSED HI-HAT ATTACHMENT

BACKGROUND OF THE INVENTION

The present invention relates to a mounting structure for cymbals, a hi-hat stand, and a closed hi-hat attachment including the mounting structure.

As disclosed in U.S. Pat. No. 5,063,819, for example, a hi-hat stand includes a stand body, a foot pedal, and a rod that selectively descends and ascends as the foot pedal is depressed or released. A hi-hat is configured by a pair of cymbals, which are a bottom cymbal supported by the upper end of the stand body in a slightly inclined posture and a top cymbal attached horizontally to the upper end of the rod.

The hi-hat is played by operating the foot pedal to cause the top cymbal attached to the rod to selectively contact and separate from the bottom cymbal. When the foot pedal is depressed, the top cymbal descends integrally with the rod. Specifically, a portion of the circumferential edge of the top cymbal initially contacts a portion of the circumferential edge of the bottom cymbal that is located higher than the remainder of the circumferential edge of the bottom cymbal. Then, the remainder of the circumferential edge of the top cymbal is brought into contact with the circumferential edge of the bottom cymbal sequentially from higher to lower portions. That is, as the foot pedal is depressed, the circumferential edge of the top cymbal and the circumferential edge of the bottom cymbal come into contact with each other not at one time but sequentially in the opposite direction from the portions at which the top cymbal and the bottom cymbal initially contact each other.

As has been described, the top cymbal contacts the bottom cymbal while changing its orientation in correspondence with the inclination angle of the bottom cymbal. In this manner, contact between the top cymbal and the bottom cymbal is brought about while allowing the air to escape from the gap between the top cymbal and the bottom cymbal. This allows the hi-hat to resonantly produce its characteristic sound. When the foot pedal is released, the top cymbal ascends integrally with the rod and separates from the bottom cymbal. In other words, the top cymbal restores its original horizontal posture from the posture inclined by the bottom cymbal.

U.S. Pat. No. 5,063,819 discloses a structure for mounting a bottom cymbal to a hi-hat stand in an inclined posture. In this structure, as illustrated in FIG. 9, a tubular retainer 101 is fixed to the upper end of a pipe 100. A flat receiving plate 102 is supported by the retainer 101 to be pivotable via a shaft 103. A damper member 106 formed of a felt piece is arranged on the top surface of the receiving plate 102 to absorb vibration from a bottom cymbal BS. A nut 101*a* is attached to the end of the retainer 101 opposite to the shaft 103. An adjustment thread 108 is threaded into the nut 101*a* with the distal end of the adjustment thread 108 facing upward. The distal end of the adjustment thread 108 is held in contact with a bottom surface 102*a* of the receiving plate 102. In this mounting structure, by rotating the adjustment thread 108 to selectively advance and retract the adjustment thread 108, the receiving plate 102 is pivoted about the shaft 103 to adjust the inclination angle of the bottom cymbal BS. The inclination angle of the bottom cymbal BS is fixed by fastening a lock nut 110, which is threaded onto the adjustment thread 108, with respect to the retainer 101.

U.S. Pat. No. 6,177,621 discloses a closed hi-hat attachment as a mounting structure for cymbals. The closed hi-hat attachment has a mounting structure for cymbals that is similar to the structure illustrated in FIG. 9.

As has been described, the top cymbal is located above the bottom cymbal when the foot pedal is not depressed. When the foot pedal is depressed, the top cymbal descends and contacts the bottom cymbal. However, in the mounting structure disclosed in U.S. Pat. No. 5,063,819, after the top cymbal ascends and descends repeatedly through depression of the foot pedal, the top cymbal may ascend without restoring its original horizontal posture after having been inclined in correspondence with the inclination angle of the bottom cymbal. Particularly, if the foot pedal is operated in a rapidly repeated manner, the top cymbal cannot restore its horizontal posture and thus ascends or descends in the inclined posture in many cases. Such movement of the top cymbal prevents the hi-hat from sufficiently producing its characteristic sound.

SUMMARY OF THE INVENTION

Accordingly, it is an objective of the present invention to provide a mounting structure for cymbals, a hi-hat stand, and a closed hi-hat attachment for ensuring resonant sound generation of the cymbals by improving contact performance between a top cymbal and a bottom cymbal.

To achieve the foregoing objective and in accordance with one aspect of the present invention, a mounting structure for mounting cymbals to an elongated member is provided. The cymbals include a top cymbal and a bottom cymbal arranged to be coaxial with and facing the top cymbal. The structure comprises a support member provided in the elongated member to support the bottom cymbal from below, a mounting member arranged above the support member in the elongated member to mount the top cymbal to the elongated member, and an urging means provided in at least one of the support member and the mounting member. The urging member urges at least one of the top cymbal and the bottom cymbal in a direction for inclining with respect to a horizontal plane perpendicular to the axis of the elongated member.

DETAILED DESCRIPTION OF THE PREFERRED EMBODIMENTS (First Embodiment)

A mounting structure for cymbals according to a first embodiment of the present invention will now be described with reference to FIGS. 1 to 5B. The mounting structure of the first embodiment is applied to a hi-hat stand 10 to which a hi-hat HS is attached.

Figure 1:
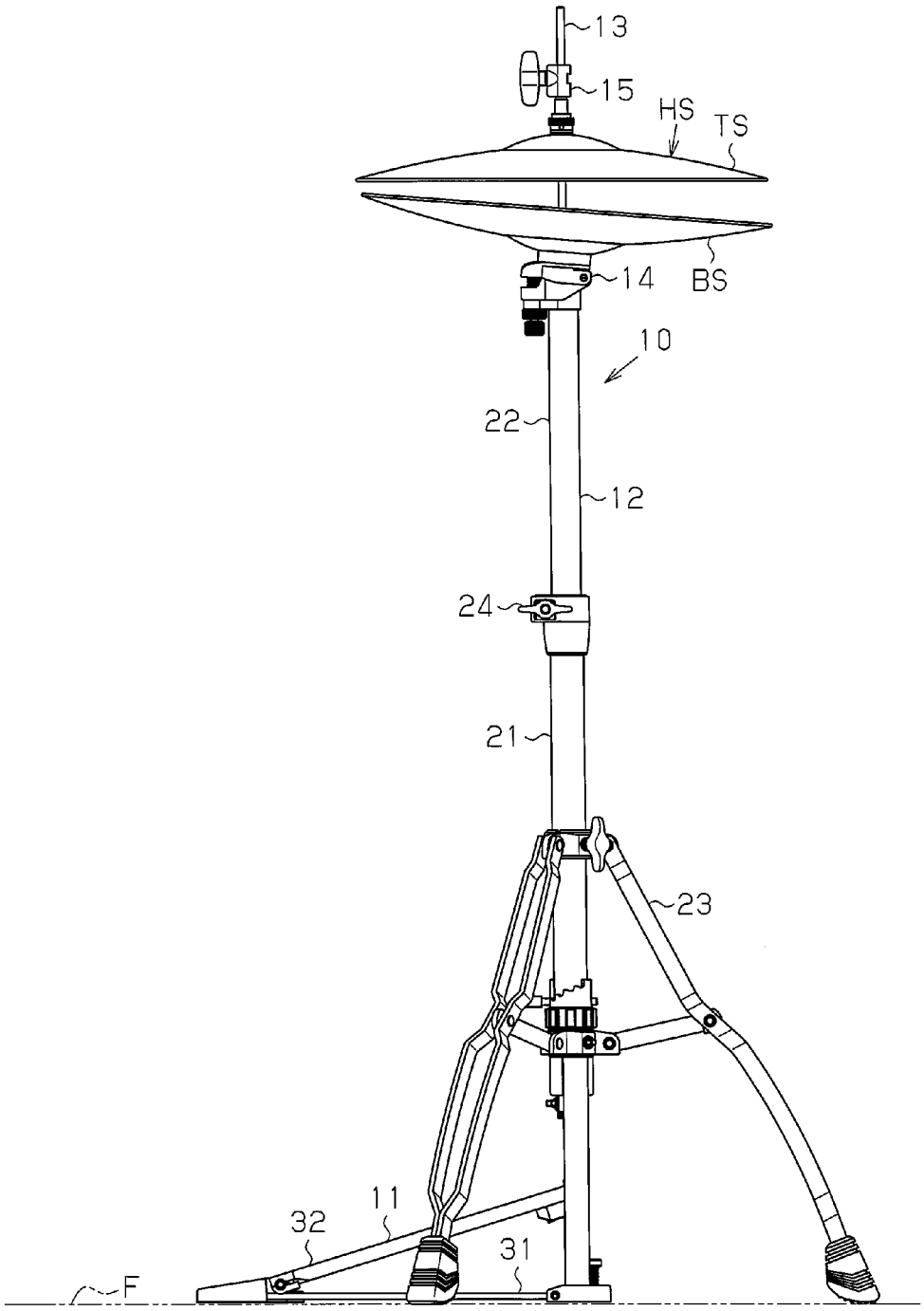
FIG. 1 is a side view showing a hi-hat stand according to a first embodiment of the present invention.

As shown in FIG. 1, the hi-hat stand 10 has a stand body 12, a foot pedal 11, a rod 13, a hi-hat bottom 14 serving as a support member, and a hi-hat clutch 15 serving as a mounting member. The stand body 12 includes a lower pipe 21, an upper pipe 22 serving as an elongated member arranged in the lower pipe 21, and a tripod 23 attached to the lower pipe 21.

The foot pedal 11 is attached to the lower end of the lower pipe 21. The foot pedal 11 has a base 31 mounted on the floor surface F and a foot plate 32 on which the player places his foot to operate the foot pedal 11. The tripod 23 supports the hi-hat stand 10 vertically to the floor surface F by opening about the axes of the pipes 21, 22. A wing screw 24 is arranged at the upper end of the lower pipe 21 and manipulated to adjust the height of the stand body 12.

The hi-hat bottom 14, which supports a bottom cymbal BS from below, is fixed to the upper end of the upper pipe 22. The rod 13 serving as an elongated member is loosely inserted in the pipes 21, 22 with the distal end of the rod 13 projecting from the upper end of the upper pipe 22. The hi-hat clutch 15 for mounting a top cymbal TS to the rod 13 is fixed to the upper end of the rod 13. The lower end of the rod 13 is linked to the distal end of the foot plate 32 via a non-illustrated link member.

The bottom cymbal BS is supported by the upper end of the upper pipe 22 through the hi-hat bottom 14 with the rod 13 passed through the central hole formed in the bottom cymbal BS. The top cymbal TS is attached to the upper end of the rod 13 through the hi-hat clutch 15 with the rod 13 extending through the central hole formed in the top cymbal TS. The top cymbal TS and the bottom cymbal BS are attached to the hi-hat stand 10 to be coaxial and facing each other.

The configuration of the hi-hat bottom 14 will hereafter be described with reference to FIGS. 2 and 4.

Figure 2:
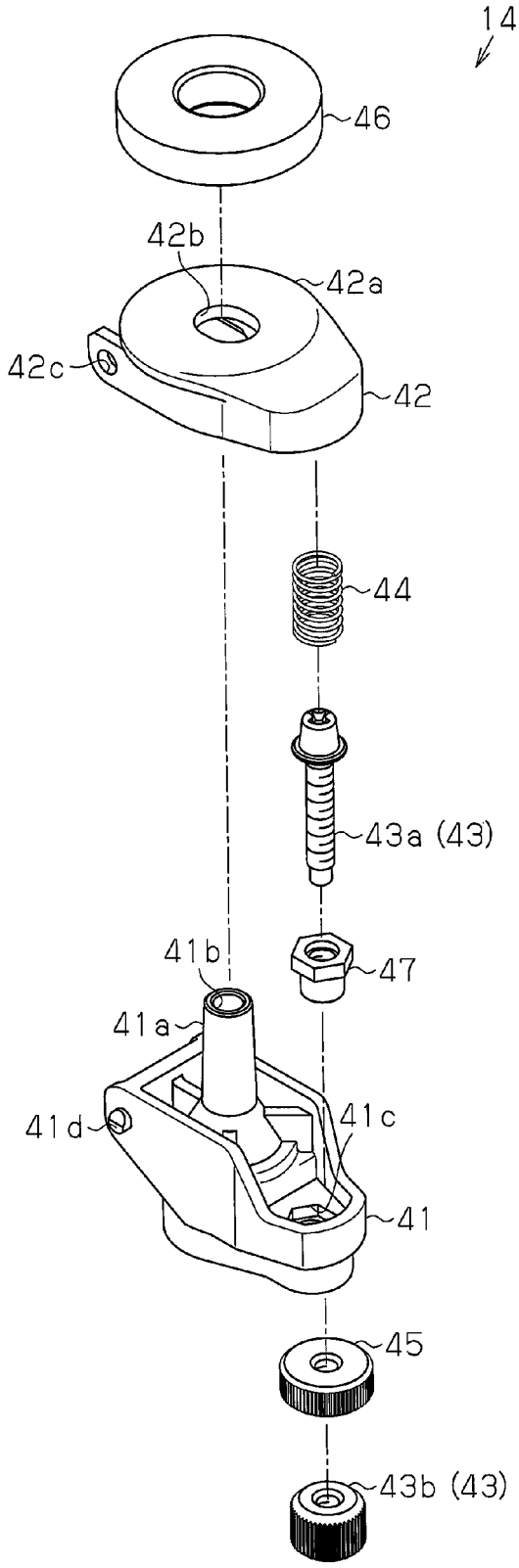
FIG. 2 is an exploded perspective view showing a hi-hat bottom.

With reference to FIG. 2, the hi-hat bottom 14 includes a substantially box-like retainer 41 having an upper opening, a receiving plate 42 on which the bottom cymbal BS is mounted, a bolt 43 configured by a shaft 43*a* and a head 43*b*, a compression coil spring 44 serving as an urging means, a lock nut 45, and a felt piece 46 serving as an annular bumper member.

The retainer 41 has a cylindrical shaft 41*a*, which is formed substantially at the center of the retainer 41. An insertion hole 41*b*, through which the rod 13 is inserted and guided, is formed in the cylindrical shaft 41*a*. An insertion hole 41*c*, through which the bolt 43 is passed, is formed in the retainer 41. A pair of projections 41*d* project from outer surfaces of the retainer 41. The projections 41*d* are arranged at the opposite side to the insertion hole 41*c* with respect to the cylindrical shaft 41*a*. The receiving plate 42 has a circular mounting portion 42*a* on which the bottom cymbal BS is mounted. An insertion hole 42*b* through which the cylindrical shaft 41*a* is passed is formed at the center of the mounting portion 42*a*.

Figure 4:
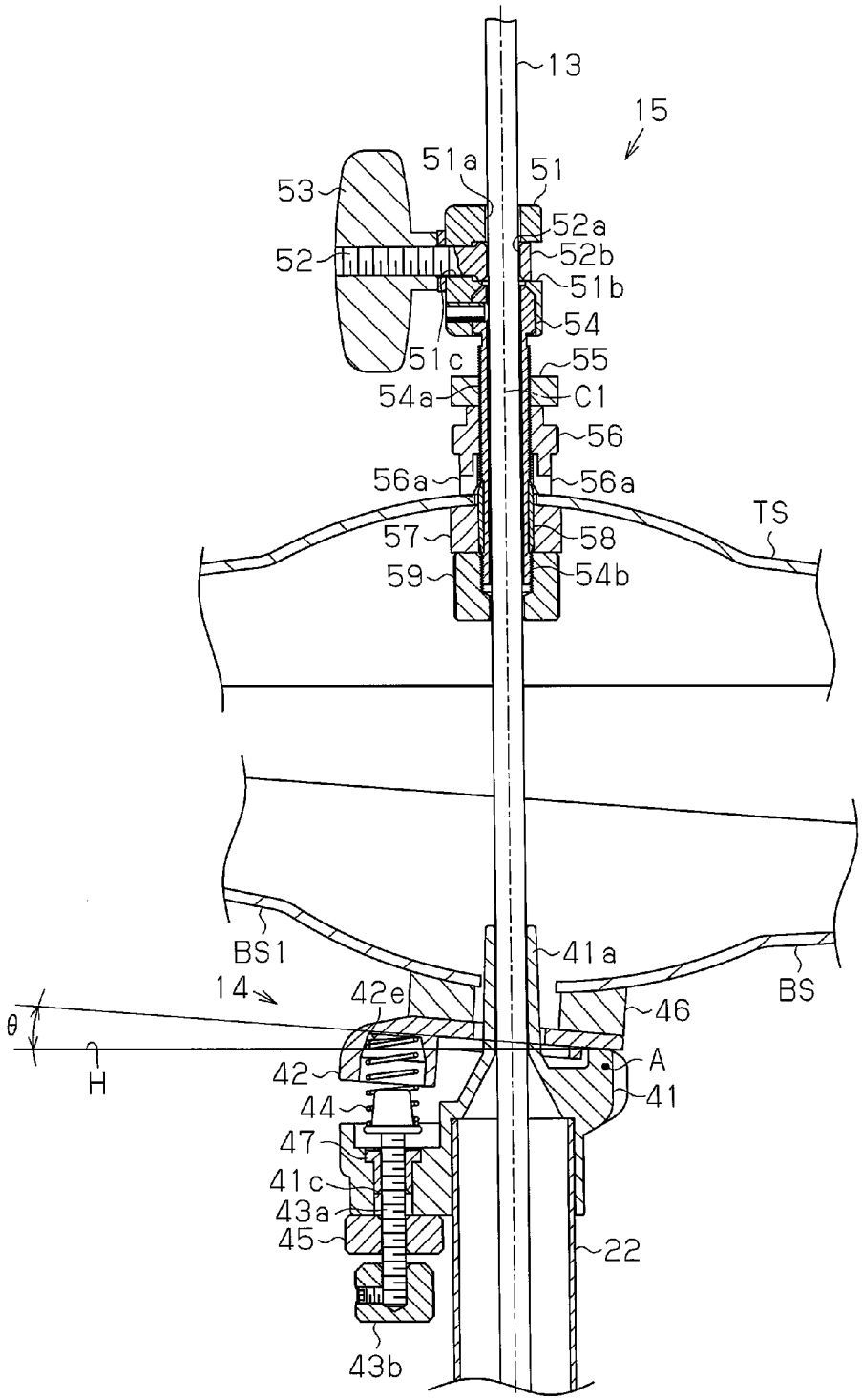
FIG. 4 is a partial cross-sectional view showing a hi-hat attached to the hi-hat stand using the hi-hat bottom and the hi-hat clutch.

As illustrated in FIG. 4, the hi-hat bottom 14 is fixed to the upper end of the upper pipe 22 via the retainer 41. The shaft 43*a* of the bolt 43 is received in the insertion hole 41*c* of the retainer 41, together with a nut 47. A lock nut 45 is threaded onto the shaft 43*a* of the bolt 43. The lower end of the shaft 43*a* of the bolt 43 projects downward from the bottom surface of the retainer 41. The head 43*b* of the bolt 43 is fixed to the lower end of the shaft 43*a* of the bolt 43.

The projections 41*d* of the retainer 41 are engaged with a pair of holes 42*c*, which are formed in proximal portions of the receiving plate 42. The receiving plate 42 is thus detachably assembled with the retainer 41. The receiving plate 42 is also attached to the retainer 41 to be pivotable about the projections 41*d*. A compression coil spring 44 is arranged between the retainer 41 and the receiving plate 42 with the axis of the compression coil spring 44 extending in the vertical direction.

The compression coil spring 44 is arranged at the opposite side to the pivotal center A of the receiving plate 42 with respect to the cylindrical shaft 41*a*. The position of the compression coil spring 44 is radially spaced from the axis C1 of the top cymbal TS and the bottom cymbal BS. The lower end of the compression coil spring 44 is supported by the upper end of the shaft 43*a* of the bolt 43. The upper end of the compression coil spring 44 is received and supported in a support recess 42*e*, which is formed in a distal portion of the receiving plate 42.

The compression coil spring 44 is compressed by the weight of the bottom cymbal BS, the felt piece 46, and the receiving plate 42 while being mounted between the receiving plate 42 and the retainer 41. The compression coil spring 44 accumulates urging force by the amount corresponding to the extent of compression and urges the distal portion of the receiving plate 42 away from the retainer 41 using the urging force. Specifically, the compression coil spring 44 urges upward a bottom surface BS1 of the bottom cymbal BS located opposite to the top cymbal TS at the position radially spaced from the axis C1 of the cymbals TS, BS. The bottom cymbal BS, together with the receiving plate 42, is inclined at a predetermined inclination angle θ with respect to the horizontal plane H in a state slightly raised by the urging force of the compression coil spring 44. Specifically, the horizontal plane H refers to a plane perpendicular to the axes of the upper pipe 22 and the rod 13 each serving as an elongated member, which is the axis C1 of the top cymbal TS and the bottom cymbal BS.

The hi-hat bottom 14 is capable of adjusting the urging force of the compression coil spring 44, which is applied to the top cymbal TS and the bottom cymbal BS when the top cymbal TS and the bottom cymbal BS contact each other. In other words, if the bolt 43, which serves as an adjustment means, is rotated to be moved upward, the receiving plate 42 is pivoted in such a direction that the distal portion of the receiving plate 42 further separates from the retainer 41. This increases the inclination angle θ of the bottom cymbal BS, and the urging force of the compression coil spring 44, which is applied to the cymbals TS, BS when the cymbals TS, BS contact each other, is also increased. In contrast, if the bolt 43 is rotated to be lowered, the receiving plate 42 pivots in such a direction that the distal portion of the receiving plate 42 approaches the retainer 41. The inclination angle θ of the bottom cymbal BS is thus reduced, and the urging force of the compression coil spring 44, which is applied to the cymbals TS, BS when the cymbals TS, BS contact each other, is also decreased. By fastening the lock nut 45 threaded onto the bolt 43 to the retainer 41, the inclination angle θ of the bottom cymbal BS is fixed.

The configuration of the hi-hat clutch 15 will hereafter be explained with reference to FIGS. 3 and 4.

Figure 3:
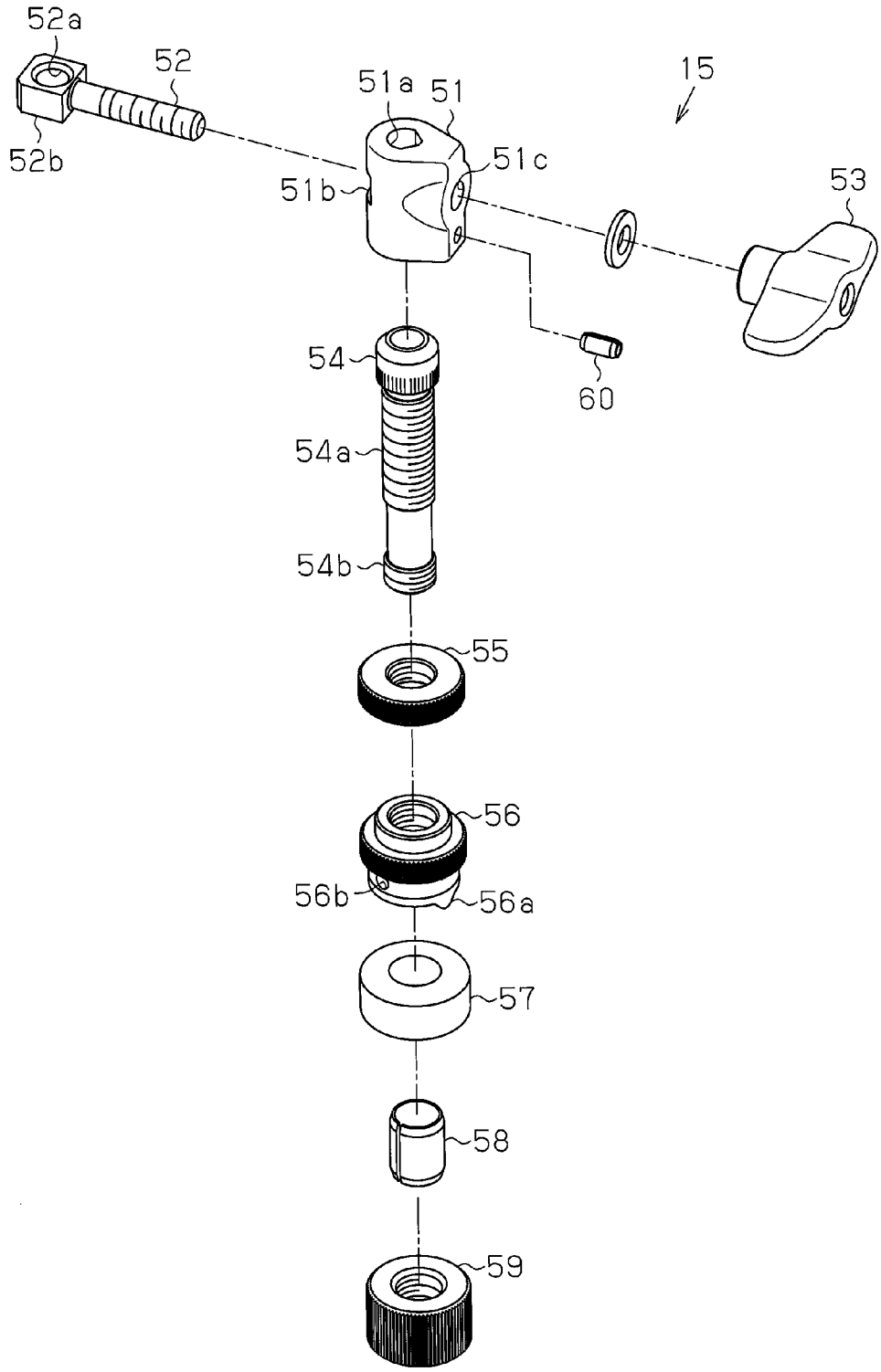
FIG. 3 is an exploded perspective view showing a hi-hat clutch.

As illustrated in FIG. 3, the hi-hat clutch 15 includes a substantially columnar clutch body 51, a thread 52, a wing nut 53 threaded onto the thread 52, a hollow bolt 54, an upper lock nut 55, an adjustment nut 56, a felt piece 57 serving as an annular bumper member, a cylindrical protective cover 58, and a lower lock nut 59. A block body 52*b* having a vertical hole 52*a* is formed at an end of the thread 52. A vertical hole 51*a* through which the rod 13 is inserted and an accommodation hole 51*b* for accommodating the block body 52*b* are formed in the clutch body 51.

The hollow bolt 54 has a first threaded portion 54*a* formed in a zone including the axial center of the hollow bolt 54 and a second threaded portion 54*b* arranged in a zone including the axial lower end of the hollow bolt 54. The adjustment nut 56 has a pair of projections 56*a*, which are held in point contact with the top cymbal TS. The projections 56*a* are arranged at opposite positions on the bottom surface of the adjustment nut 56. An indication mark 56*b* for indicating the orientation of the hi-hat clutch 15 attached to the rod 13 is formed on the outer circumferential surface of the adjustment nut 56.

With reference to FIG. 4, the hi-hat clutch 15 is fixed to the upper end of the rod 13 via the clutch body 51. The thread 52 is passed through a lateral hole 51*c* formed in the clutch body 51 with the vertical hole 52*a* of the block body 52*b* aligned with the vertical hole 51*a* of the clutch body 51. By fastening the wing nut 53 threaded onto the thread 52 to the clutch body 51, the rod 13 is pressed against the wall of the vertical hole 51*a* of the clutch body 51 via the block body 52*b*. The hi-hat clutch 15 is thus fixed to the rod 13.

The hollow bolt 54 is press fitted into the vertical hole 51*a* of the clutch body 51 from below and fixed to a lower portion of the clutch body 51 via a fixing pin 60. The upper lock nut 55 and the adjustment nut 56 are threaded onto the first threaded portion 54*a* of the hollow bolt 54. The felt piece 57, the protective cover 58, and the lower lock nut 59 are mounted on a portion of the hollow bolt 54 below the first threaded portion 54*a*, with the top cymbal TS arranged between the felt piece 57, the protective cover 58, and the lower lock nut 59 and the adjustment nut 56. The lower lock nut 59 is threaded onto the second threaded portion 54*b* of the hollow bolt 54.

The hi-hat clutch 15 is attached to the upper end of the rod 13 with the top cymbal TS clamped between the adjustment nut 56 threaded onto the first threaded portion 54*a* and the lower lock nut 59 threaded onto the second threaded portion 54*b*. In this state, the lower lock nut 59 is fastened to the second threaded portion 54*b* and thus presses the backside of the top cymbal TS. The adjustment nut 56 is fastened to the first threaded portion 54*a* and thus presses the top surface of the top cymbal TS. The upper lock nut 55 locks the adjustment nut 56 to prevent the adjustment nut 56 from loosening from the state fastened to the first threaded portion 54*a* by a desired level of torque.

Operation of the hi-hat stand 10 will now be described with reference to FIGS. 1, 5A, and 5B.

Figure 5A:
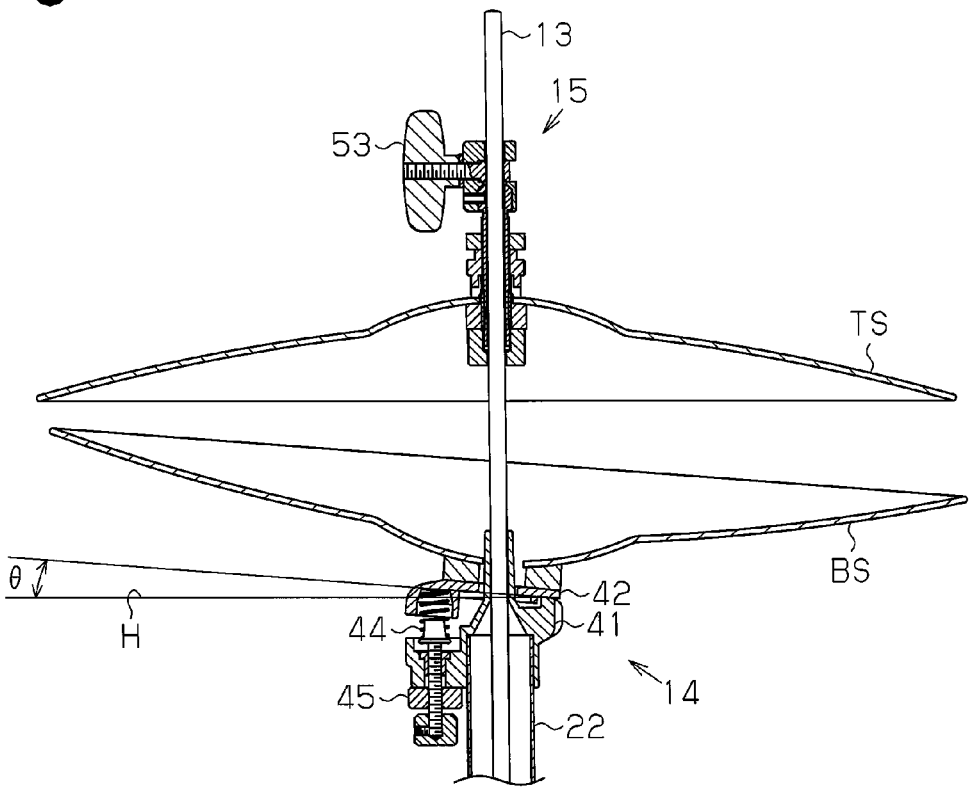
FIG. 5A is a cross-sectional view showing a top cymbal and a bottom cymbal at the time when a foot plate is not depressed.

When the foot plate 32 is not depressed by the player, the top cymbal TS is separate from the bottom cymbal BS as illustrated in FIG. 5A. In this state, the top cymbal TS is fixed to the upper end of the rod 13 in a horizontal posture maintained by the hi-hat clutch 15. The bottom cymbal BS is supported by the upper end of the upper pipe 22 in a posture inclined at a predetermined inclination angle θ by the urging force of the compression coil spring 44.

Figure 5B:
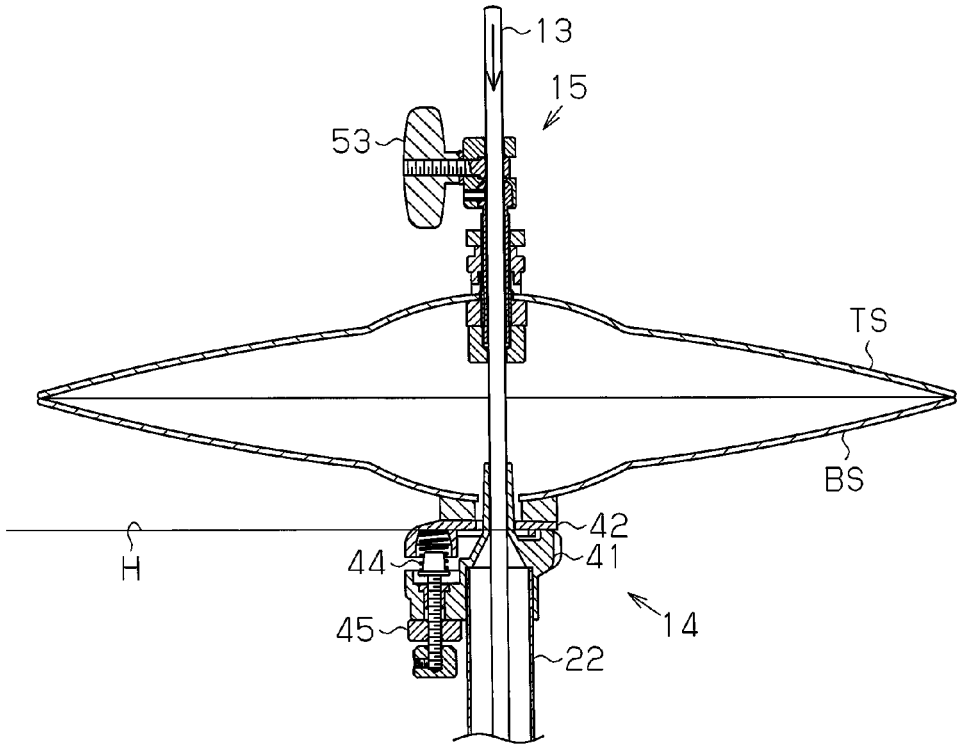
FIG. 5B is a cross-sectional view showing the top cymbal and the bottom cymbal at the time when the foot plate is depressed.

When the foot plate 32 is depressed by the player, the rod 13 descends in correspondence with movement of the distal end of the foot plate 32 as illustrated in FIG. 5B. This lowers the top cymbal TS, and a portion of the circumferential edge of the top cymbal TS first contacts the circumferential edge of the bottom cymbal BS. The circumferential edge of the top cymbal TS then contacts the bottom cymbal BS sequentially from the first contact position toward the opposite side of to the first contact position. At this stage, the top cymbal TS descends while maintained in the horizontal posture by the hi-hat clutch 15.

Meanwhile, the compression coil spring 44 is compressed through depression by the top cymbal TS. This causes the bottom cymbal BS to change its inclination to reach a horizontal posture in correspondence with the top cymbal TS. When the foot plate 32 is depressed, the compression coil spring 44 urges the cymbals TS, BS in such a direction that the cymbals TS, BS contact each other. As a result, the top cymbal TS, which is lowered together with the rod 13, is reliably brought into contact with the bottom cymbal BS by the urging force of the compression coil spring 44.

When the foot plate 32 is released, the rod 13 is raised in correspondence with movement of the distal end of the foot plate 32. Also at this stage, the top cymbal TS ascends while maintained in the horizontal posture by the hi-hat clutch 15. The compression coil spring 44 is released from the compressed state through ascent of the top cymbal TS. This returns the bottom cymbal BS from the horizontal posture to the original posture inclined at the predetermined inclination angle θ (the posture illustrated in FIG. 5A). In this manner, the top cymbal TS selectively contacts and separates from the bottom cymbal BS by ascending or descending while constantly maintained in the horizontal posture.

The first embodiment has the advantages described below.

(1) The hi-hat bottom 14 has the compression coil spring 44 serving as an urging means. The compression coil spring 44 is radially spaced from the axis C1 of the top cymbal TS and the bottom cymbal BS. In this configuration, in the hi-hat HS, which is played by causing the top cymbal TS to selectively contact and separate from the bottom cymbal BS, for example, the bottom cymbal BS changes its inclination to reach the horizontal posture in correspondence with the top cymbal TS using the urging force of the compression coil spring 44 when the foot plate 32 is depressed. The top cymbal TS and the bottom cymbal BS are thus reliably brought into contact with each other. When the foot plate 32 is released, the bottom cymbal BS restores its original posture, which is inclined at the predetermined inclination angle θ, from the horizontal posture, using the urging force of the compression coil spring 44. In other words, since the bottom cymbal BS changes its inclination to reach the horizontal posture in correspondence with the top cymbal TS, the top cymbal TS is selectively raised and lowered while maintaining a horizontal posture. As a result, even if the foot pedal 11 is operated in a quickly repeated manner, the hi-hat HS is allowed to sufficiently produce its characteristic sound.

(2) The compression coil spring 44 urges upward the bottom surface BSI of the bottom cymbal BS, which is located opposite to the top cymbal TS, at a position radially spaced from the axis C1 of the cymbals TS, BS. In this configuration, the contact performance between the top cymbal TS and the bottom cymbal BS is further improved by elastically supporting the bottom cymbal BS from below by means of the compression coil spring 44. In the case of the hi-hat HS, the inclination of the bottom cymbal BS is smoothly changed in correspondence with upward/downward movement of the top cymbal TS. As a result, even when the foot pedal 11 is operated in a quickly repeated manner, the hi-hat HS is allowed to produce its characteristic sound further resonantly.

(3) The receiving plate 42 is attached to the retainer 41 to be pivotable about the two projections 41*d*. The compression coil spring 44 urges the distal portions of the receiving plate 42 away from the retainer 41. In this configuration, since the receiving plate 42 is pivotably attached to the retainer 41, the receiving plate 42 is smoothly pivoted in correspondence with movement of the bottom cymbal BS. The inclination of the bottom cymbal BS is thus further smoothly changed in correspondence with upward/downward movement of the top cymbal TS. Also, since the first embodiment does not necessitate great change to the design of the conventional hi-hat bottom, less work is required to redesign the known components and prepare additional components. This reduces design cost and thus manufacturing cost as well.

(4) The hi-hat bottom 14 is configured to be capable of adjusting the urging force of the compression coil spring 44, which is applied to the top cymbal TS and the bottom cymbal BS when the top cymbal TS and the bottom cymbal BS contact each other. In this configuration, by rotating the bolt 43 as an adjustment means, the urging force of the compression coil spring 44 applied to the top cymbal TS and the bottom cymbal BS when the top cymbal TS and the bottom cymbal BS contact each other is adjusted. In this manner, the feeling in striking the hi-hat HS or the sound of the hi-hat HS is adjusted.

(5) The receiving plate 42 is detachably assembled with the retainer 41. In this configuration, the compression coil spring 44 mounted between the receiving plate 42 and the retainer 41 can be replaced by removing the receiving plate 42 from the retainer 41. Replacement of the compression coil spring 44 by a compression coil spring having a different constant of spring enlarges the adjustment range of the feeling of striking the hi-hat HS and the adjustment range of the sound of the hi-hat HS.

(6) The adjustment nut 56 has the two projections 56*a*, which contact the top cymbal TS. This configuration reduces the contact area between the hi-hat clutch 15 and the top cymbal TS. The hi-hat clutch 15 is thus prevented from hampering vibration of the top cymbal TS, and the sound of the hi-hat HS is further resonantly produced.

(7) Depending on the orientation of the hi-hat clutch 15, the projections 56*a* of the adjustment nut 56 may hamper the vibration of the top cymbal TS and thus prevent the hi-hat HS from resonantly producing its sound. For example, in the first embodiment, when the two projections 56*a* of the adjustment nut 56 are located at the positions offset at 90 degrees from the striking position of the hi-hat HS, the vibration of the hi-hat HS is facilitated and thus the hi-hat HS is allowed to resonantly produce its sound, compared to when the projections 56*a* are aligned with the striking position of the hi-hat HS. In this regard, in the first embodiment, the indication mark 56*b* is formed on the outer circumferential surface of the adjustment nut 56. This allows the player to adjust the orientation of the hi-hat clutch 15 with reference to the indication mark 56*b* of the adjustment nut 56 as needed in such a manner as to facilitate the vibration of the hi-hat HS. The projections 56*a* of the adjustment nut 56 are thus prevented from hampering the vibration of the top cymbal TS.

(Second Embodiment)

A mounting structure for cymbals according to a second embodiment of the present invention will now be described with reference to FIGS. 6 and 7. The mounting structure of the second embodiment is applied to a closed hi-hat attachment 80. Detailed description of the components of the second embodiment that are the same as the corresponding components of the first embodiment will be omitted herein.

Figure 6:
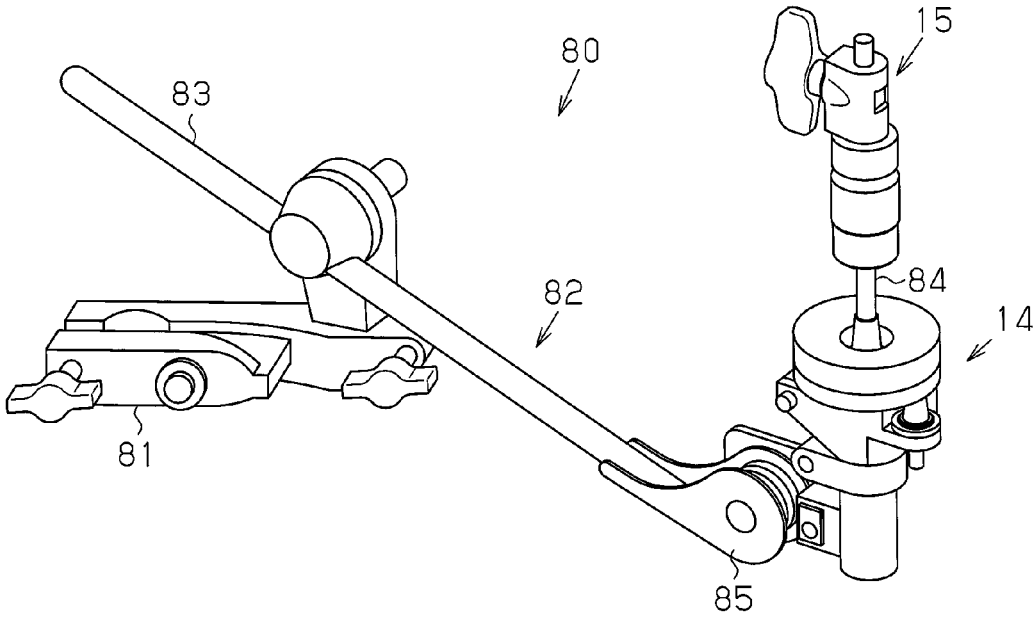
FIG. 6 is a perspective view showing a closed cymbal attachment according to a second embodiment of the present invention.

As illustrated in FIG. 6, a closed hi-hat attachment 80 has a clamp 81, a rod assembly 82, a hi-hat bottom 14 serving as a support member, and a hi-hat clutch 15 serving as a mounting member. The clamp 81 clamps an object such as a musical instrument stand or a pipe to which a closed hi-hat CH is attached. The rod assembly 82 includes a first rod 83 to which the clamp 81 is fixed, a second rod 84 to which the closed hi-hat CH is attached, and a link member 85 by which the first and second rods 83, 84 are pivotably linked to each other.

Figure 7:
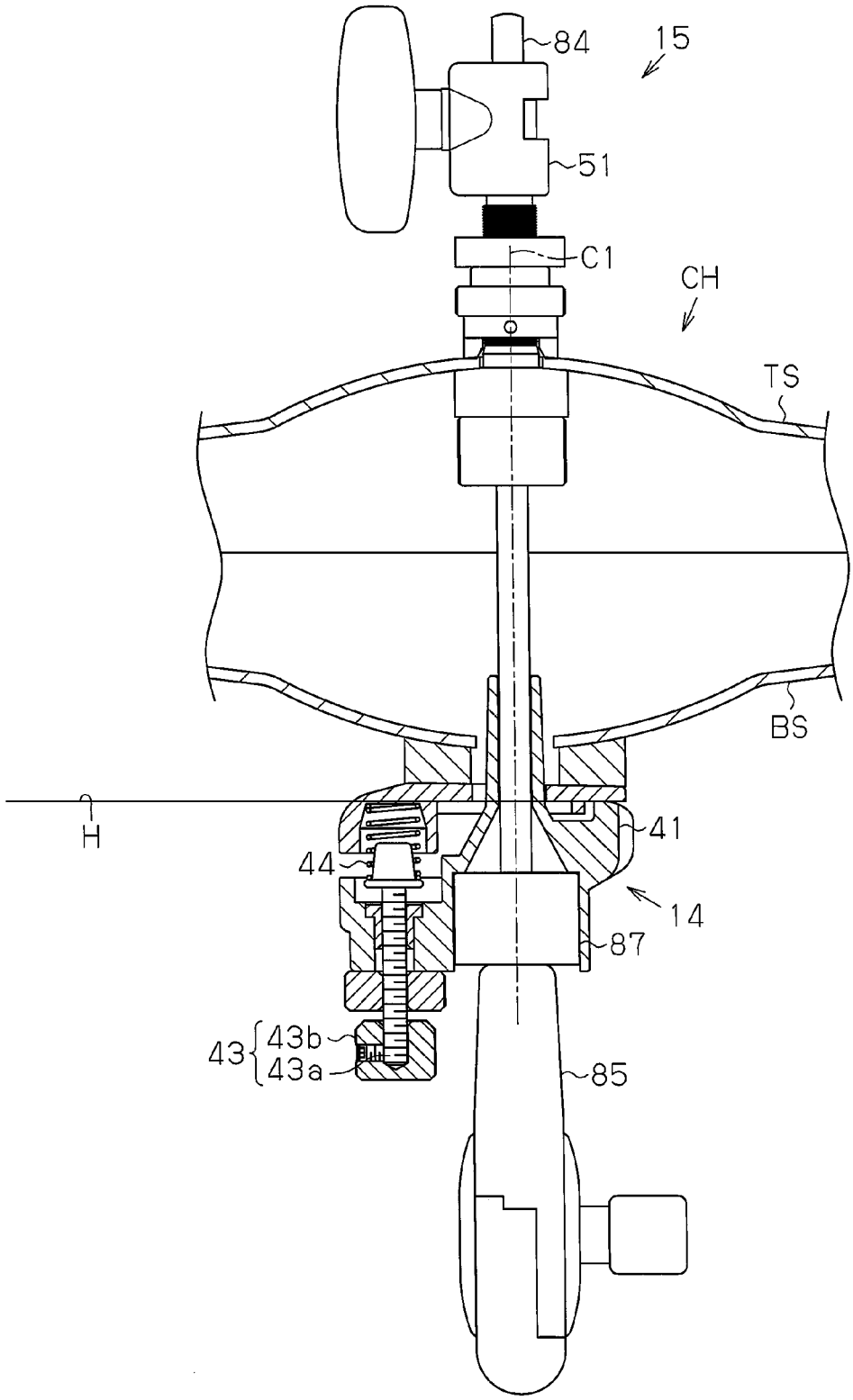
FIG. 7 is a cross-sectional view showing a closed hi-hat attached to the closed hi-hat attachment using a hi-hat bottom and a hi-hat clutch.

With reference to FIG. 7, the hi-hat bottom 14 is fixed to a columnar member 87, which is formed at the lower end of the second rod 84, via the retainer 41. The hi-hat clutch 15 is fixed to the upper end of the second rod 84 via the clutch body 51. The closed hi-hat CH is configured by a pair of cymbals including a top cymbal TS and a bottom cymbal BS. The top cymbal TS is attached to the upper end of the second rod 84 in a horizontal posture maintained by the hi-hat clutch 15. The bottom cymbal BS is supported by the lower end of the second rod 84 via the hi-hat bottom 14.

In this state, the bottom cymbal BS is urged in a direction inclined with respect to the horizontal plane H by the urging force of the compression coil spring 44 and thus pressed against the top cymbal TS. However, since the top cymbal TS is maintained horizontal by the hi-hat clutch 15, the bottom cymbal BS is maintained horizontal in correspondence with the top cymbal TS. Specifically, the horizontal plane H refers to a plane perpendicular to the axis of the second rod 84 serving as an elongated member, which is the axis C1 of the top cymbal TS and the bottom cymbal BS. Further, in the second embodiment, the top cymbal TS is held in contact with the bottom cymbal BS in such a manner that the circumferential edge of the top cymbal TS tightly contact the circumferential edge of the bottom cymbal BS.

The second embodiment has the advantage described below.

(8) In the mounting structure of the second embodiment, the contact performance between the top cymbal TS and the bottom cymbal BS is improved compared to a conventional mounting structure without an urging means such as the compression coil spring 44. As a result, compared to a case in which the closed hi-hat CH is mounted using a conventional closed hi-hat attachment, the closed hi-hat CH is allowed to produce its sound further resonantly.

Further, by rotating the bolt 43 to adjust the urging force of the compression coil spring 44, which is applied to the top cymbal TS and the bottom cymbal BS, the sound of the closed hi-hat CH may be changed as desired by the player. In other words, by incorporating the compression coil spring 44 in the closed hi-hat attachment 80, the adjustment range of the sound of the closed hi-hat CH is enlarged compared to a case using a conventional closed hi-hat attachment.

The first and second embodiments may be modified to the forms described below.

Figure 8:
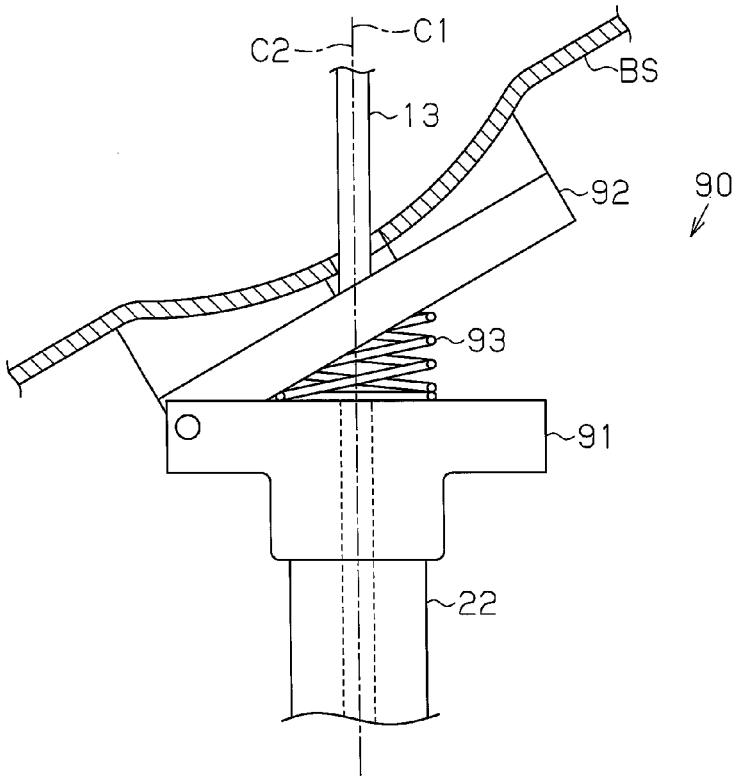
FIG. 8 is a diagram illustrating the mounting position of a compression coil spring according to a modified embodiment.
Figure 9:
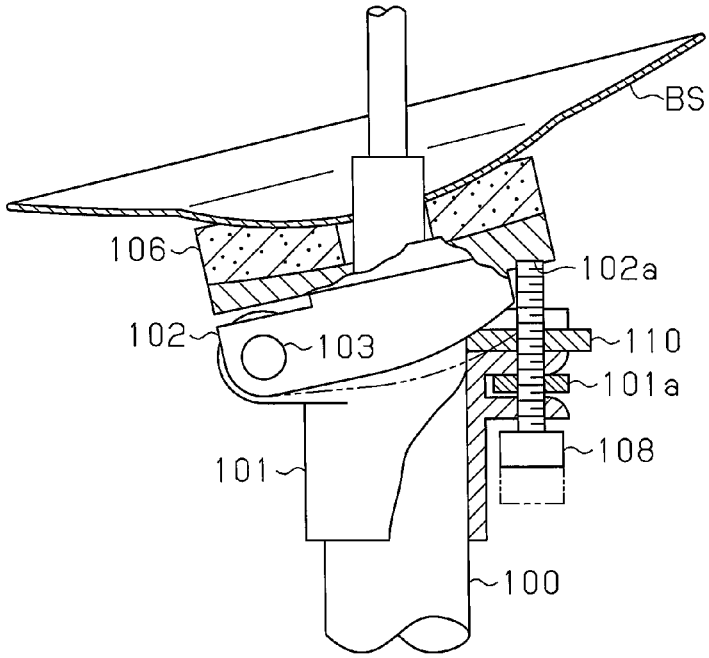
Fig.9(Prior Art)
FIG. 9 is a partial cross-sectional view showing a bottom cymbal attached to a stand body using a conventional hi-hat bottom.

In the first and second embodiments, the mounting position of the compression coil spring 44 may be modified to the position illustrated in FIG. 8. In this case, a hi-hat bottom 90 includes a retainer 91 fixed to the upper end of the upper pipe 22, a receiving plate 92 pivotably connected to the retainer 91, and a compression coil spring 93 mounted between the retainer 91 and the receiving plate 92. The compression coil spring 93 is arranged in such a manner that the axis C2 of the compression coil spring 93 is aligned with the axis C1 of the top cymbal TS and the bottom cymbal BS. Also in this configuration, the compression coil spring 93 urges the bottom surface of the bottom cymbal BS in such a manner as to incline the bottom cymbal BS with respect to the rod 13.

In the first embodiment, the compression coil spring 44 may be attached to the hi-hat clutch 15 in such a manner as to urge the top surface of the top cymbal TS facing the bottom cymbal BS. In this case, the top cymbal TS is supported in a posture inclined at a predetermined inclination angle θ by the urging force of the compression coil spring 44. When the foot plate 32 is depressed by the player, the top cymbal TS changes its inclination to reach a horizontal posture in correspondence with the bottom cymbal BS. Also in the second embodiment, the compression coil spring 44 may be attached to the hi-hat clutch 15 in such a manner as to urge the top surface of the top cymbal TS facing the bottom cymbal BS.

In the first and second embodiments, the receiving plate 42 may be omitted from the hi-hat bottom 14. In other words, the hi-hat bottom 14 may be configured in such a manner that the compression coil spring 44 directly urges the bottom surface of the bottom cymbal BS.

In the first and second embodiments, the bolt 43 serving as an adjustment means may be omitted. Specifically, the adjustment function for the urging force applied to the top cymbal TS and the bottom cymbal BS at the time when the top cymbal TS and the bottom cymbal BS contact each other may be omitted from the hi-hat bottom 14.

In the first and second embodiments, the two projections 56*a* may be omitted from the adjustment nut 56 configuring the hi-hat clutch 15. In this case, the projections 56*a* may be replaced by a felt piece serving as a bumper member, which is arranged between the adjustment nut 56 and the top cymbal TS.

In the first and second embodiments, the indication mark 56*b* may be omitted from the adjustment nut 56 configuring the hi-hat clutch 15.

In the second embodiment, using the hi-hat clutch 15 and the hi-hat bottom 14, the closed hi-hat CH may be attached to various types of cymbal stands.

The invention claimed is:

1. A mounting structure for mounting cymbals to an elongated member that defines a longitudinal axis, wherein the cymbals include a top cymbal and a bottom cymbal, and the bottom cymbal is arranged to be substantially coaxial with and facing the top cymbal, the structure comprising:

a support member engaging the elongated member, wherein the support member is operative to support the bottom cymbal from below, and the support member includes a retainer fixed to the elongated member and a receiving plate pivotally attached to the retainer to receive the bottom cymbal;

a mounting member engaging the elongated member and arranged above the support member, wherein the mounting member mounts the top cymbal to the elongated member; and a spring member arranged between the receiving plate and the retainer and located opposite to a pivot axis of the receiving plate, wherein the receiving plate is supported by the retainer at a location opposite to the pivot axis of the receiving plate only by the spring member, and the spring member is operative to bias a motion of the bottom cymbal towards an inclined angle with respect to a plane substantially orthogonal to the axis defined by the elongated member.

2. The mounting structure for cymbals according to claim 1, wherein the top cymbal is attached to the elongated member in such a manner that the top cymbal selectively contacts and separates from the bottom cymbal.

3. The mounting structure for cymbals according to claim 1, wherein the spring member is radially spaced from the axis of the top cymbal and the bottom cymbal.

4. The mounting structure for cymbals according to claim 1, wherein the spring member urges a lower surface of the bottom cymbal located opposite to the top cymbal.

5. The mounting structure for cymbals according to claim 1, wherein the receiving plate is attachable and detachable with respect to the retainer.

6. The mounting structure for cymbals according to claim 1, wherein the mounting member includes a pair of projections arranged at opposite positions and makes point contacts with the top cymbal via the two projections.

7. The mounting structure for cymbals according to claim 6, wherein an indication mark is formed on a surface of the mounting member, the indication mark indicating an orientation of the mounting member attached to the elongated member.

8. A hi-hat stand to which a hi-hat configured by a top cymbal and a bottom cymbal is attached, wherein the bottom cymbal is arranged to be substantially coaxial with and facing the top cymbal, the hi-hat stand comprising:

a stand body having a hollow pipe;

a foot pedal provided at a lower end of the stand body and in which the foot pedal when operated plays the hi-hat;

a rod defining a longitudinal axis, the rod arranged in the pipe and selectively raised and lowered through depression of the foot pedal;

a support member arranged at an upper end of the pipe to support the bottom cymbal from below, wherein the support member includes a retainer fixed to the pipe and a receiving plate pivotally attached to the retainer to receive the bottom cymbal;

a mounting member fixed to the rod projecting upward from the pipe, the mounting member mounting the top cymbal to the rod; and a spring member arranged between the receiving plate and the retainer and located opposite to a pivot axis of the receiving plate, wherein the receiving plate is supported to the retainer at a location opposite to the pivot axis of the receiving plate only by the spring member, and wherein the spring member is operative to bias a motion of the bottom cymbal towards an inclined angle with respect to a plane substantially perpendicular to the axis of the rod.

9. The structure of claim 1, wherein the spring member includes a coil spring.

10. The hi-hat stand of claim 8, wherein the spring member includes a coil spring.

* * * * *